US007504962B2

(12) United States Patent
Smith

(10) Patent No.: US 7,504,962 B2
(45) Date of Patent: Mar. 17, 2009

(54) APPARATUS FOR ENCLOSING A SMOKE DETECTOR

(76) Inventor: Joseph Stephen Smith, 3458 Woodbridge Pkwy., Palm Harbor, FL (US) 34684

( * ) Notice: Subject to any disclaimer, the term of this patent is extended or adjusted under 35 U.S.C. 154(b) by 213 days.

(21) Appl. No.: 11/283,712

(22) Filed: Nov. 22, 2005

(65) Prior Publication Data

US 2007/0115134 A1 May 24, 2007

(51) Int. Cl.
*G08B 23/00* (2006.01)

(52) U.S. Cl. ..... 340/693.11; 340/693.6; 340/693.12; 340/628

(58) Field of Classification Search ..... 340/693.6, 340/693.9, 693.11, 396.12, 628–630, 693.12; 73/863, 863.1, 864.33, 864.81–87
See application file for complete search history.

(56) References Cited

U.S. PATENT DOCUMENTS

| | | | | |
|---|---|---|---|---|
| 3,042,907 A | | 7/1962 | Redway | |
| 3,838,283 A | * | 9/1974 | Andersson | 250/381 |
| 4,177,461 A | * | 12/1979 | Brown et al. | 340/628 |
| 4,478,048 A | | 10/1984 | Dills | |
| 4,608,556 A | | 8/1986 | Cole et al. | |
| 4,613,297 A | | 9/1986 | Zanias et al. | |
| 4,833,458 A | | 5/1989 | Bowman | |
| 4,968,975 A | | 11/1990 | Fritz | |
| 5,280,273 A | * | 1/1994 | Goldstein | 340/632 |
| 5,519,382 A | | 5/1996 | Pope et al. | |
| 5,537,096 A | | 7/1996 | Wagner et al. | |
| 5,552,775 A | | 9/1996 | Harley et al. | |
| 5,610,592 A | | 3/1997 | Okazaki et al. | |
| 5,773,730 A | | 6/1998 | McConnell et al. | |
| 5,917,417 A | * | 6/1999 | Girling et al. | 340/628 |
| 6,166,648 A | | 12/2000 | Wiemeyer et al. | |
| 6,285,291 B1 | | 9/2001 | Knox et al. | |
| 6,407,671 B1 | | 6/2002 | Mulvihill et al. | |

(Continued)

FOREIGN PATENT DOCUMENTS

EP 0197371 3/1986

(Continued)

OTHER PUBLICATIONS

"Duct Application Smoke Detectors," http://www.systemsensor.com/html/guides/A05-1004.pdf. (2002).

(Continued)

*Primary Examiner*—Daniel Wu
*Assistant Examiner*—Hongmin Fan
(74) *Attorney, Agent, or Firm*—Wilmer Cutler Pickering Hale and Dorr LLP

(57) ABSTRACT

An apparatus for enclosing a smoke detector is provided. In one embodiment of the present invention, the apparatus includes an extension that has an open end for positioning within a space on a first side of a partition and a housing end for positioning within a space on a second side of the partition. The open end is exposed to ambient air within the space on the first side of the partition. A smoke detector enclosure for receiving the smoke detector is provided. At least a portion of the smoke detector enclosure contacts a portion of the tubular extension. A cover can also be secured to the smoke detector enclosure.

15 Claims, 5 Drawing Sheets

U.S. PATENT DOCUMENTS

| | | | | |
|---|---|---|---|---|
| 6,720,886 | B2 | 4/2004 | Seelbach et al. | |
| 6,940,410 | B2 * | 9/2005 | Deacy | 340/628 |
| 2004/0035184 | A1 | 2/2004 | Yamano et al. | |

FOREIGN PATENT DOCUMENTS

| | | |
|---|---|---|
| EP | 0424881 | 10/1990 |
| EP | 1056062 | 11/2000 |
| GB | 2243475 | 10/1991 |
| GB | 2281139 | 2/1995 |
| JP | 04-092997 | 3/1992 |
| JP | 05-151480 | 6/1993 |
| JP | 05-307690 | 11/1993 |
| JP | 05-325063 | 12/1993 |

OTHER PUBLICATIONS

"Silent Knight." http://www.ademcoint.com/pdfs/silent/sk-sd505adhrip.pdf. (1999).

"Thermal Fire Detectors." http://www.sbt.siemens.com/FIS/productdoc/catalogs/6131.pdf. (May 2003).

* cited by examiner

APPARATUS FOR ENCLOSING A SMOKE DETECTOR

BACKGROUND OF THE INVENTION

1. Field of the Invention

Embodiments of the present invention generally relate to a housing for a smoke detector and, more particularly, to a housing that enables a smoke detector to detect smoke in remote spaces.

2. Background Description

Smoke and fire detectors are manufactured in a variety of configurations. Most detectors designed to be installed in a previously existing structure are battery powered, and can thus be installed as required in areas of a building where people live and/or work.

Known smoke detectors often include a vented housing with an internal smoke chamber. An ionization-type or a photoelectric-type smoke sensor, for example, can be located in the housing, where ambient air circulates into and out of the housing.

Each year, many fires start in areas that are inaccessible or remote from the living and/or working area(s) of a building. For example, the attic of a home typically contains combustible and/or flammable materials, electrical wiring and/or other potential fire initiating and/or contributing elements. An attic fire, for example, can burn for some time before it breaks through the ceiling or wall to be sensed by a detector mounted on the opposite side of the ceiling or wall in, for example, a living area.

One or more embodiments of the present invention relate to a housing for a smoke detector that enables a smoke detector to detect smoke in remote spaces, thereby advantageously enabling detection of smoke prior to a fire breaking through, for example, a ceiling or wall.

SUMMARY OF THE INVENTION

In one embodiment of the present invention, and apparatus for enclosing a smoke detector is provided. A tubular extension is provided that has an open end for positioning within a space on a first side of a partition and a housing end for positioning within a space on a second side of the partition. The open end is exposed to ambient air within the space on the first side of the partition. In addition, a smoke detector enclosure receives the smoke detector, and is configured so that at least a portion of the smoke detector enclosure contacts a portion of the tubular extension.

In another embodiment of the present invention, an apparatus for enclosing a smoke detector is provided that includes a tubular extension having an open end for positioning within a space on a first side of a partition and a housing end for positioning within a space on a second side of the partition. The open end receives ambient air that passes through the tubular extension toward the housing end. A substantially planar partition is positioned within the tubular extension, partitioning the tubular extension into an intake portion and an exhaust portion. A smoke detector enclosure receives the smoke detector, and is configured so that at least a portion of the smoke detector enclosure contacts a portion of the tubular extension. In addition, a fan can be provided that directs air to the smoke detector. The fan can be at least partially located within the intake section.

LIST OF FIGURES

DESCRIPTION OF EMBODIMENTS OF THE INVENTION

Figure 1:
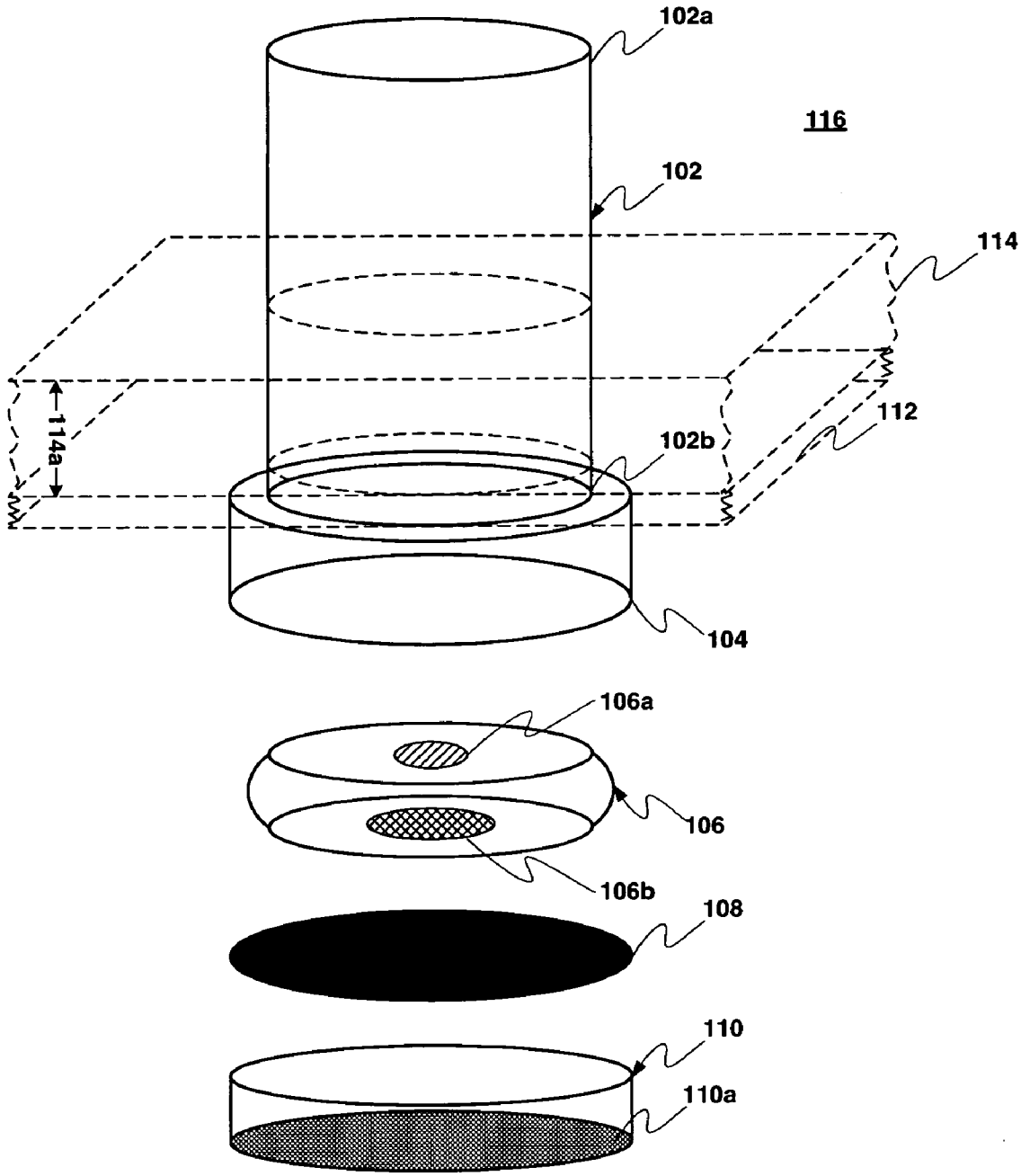
FIG. 1 is an expanded schematic view of an exemplary apparatus for housing a smoke detector in accordance with an embodiment of the present invention.

FIG. 1, generally at 100, shows an exploded view of a housing 104 and cover 110 for enclosing a smoke detector 106. A proximal end 102*b* of tube 102 may be secured to or integral with housing 104, such that tube 102 can be fitted, for example, through an opening in an insulated or non-insulated ceiling 112, wall, floor, etc., and into an adjacent attic, crawl space, garage, or similar air space 116. In one embodiment, proximal end 102*b* can be flush with a lower surface of ceiling 112. Smoke detector 106 includes sensor 106*a* which detects the presence of smoke, and alarm speaker 106*b*. The internal diameter of housing 104 is large enough to receive smoke detector 106.

Figure 2:
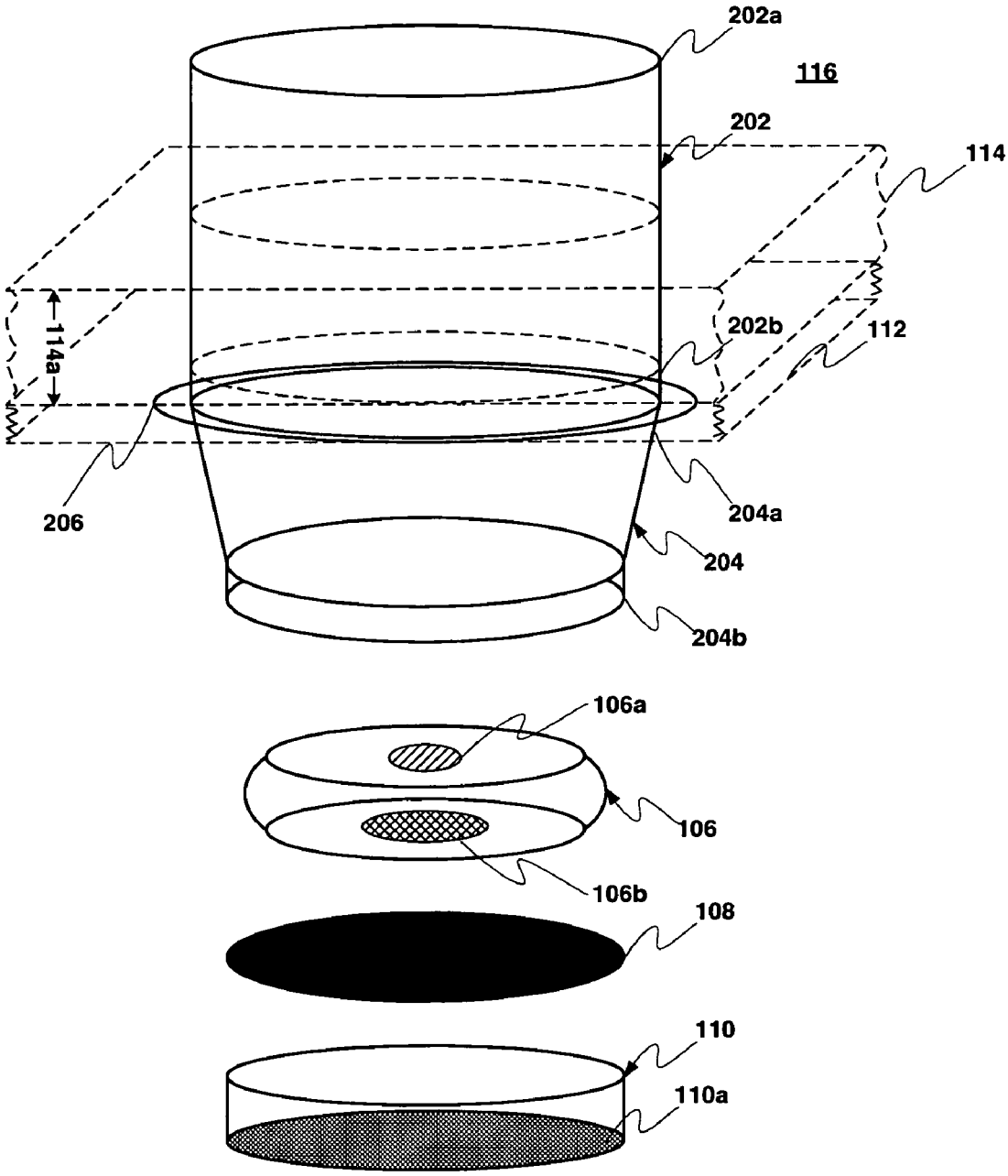
FIG. 2 is an expanded schematic view of a second embodiment of an exemplary apparatus for housing a smoke detector.

In one embodiment of the present invention, housing 104 can include a wall-mounting ring, such as shown in FIG. 2, element 206. Cover 110 engages housing 104 such that cover 110 secures smoke detector 106 within the confines of housing 104. In one embodiment of the present invention, cover 110 is a threaded cover. The distal end 102*a* of tube 102 can be inserted through a hole cut (or otherwise provided) into a ceiling 112, wall, floor, etc., and through any adjacent insulation 114, so that ambient air can flow through tube 102 to smoke detector 106 enclosed within housing 104. Tube 102 can be sized such that it extends beyond, for example, any insulation 114 of width indicated by arrow 114*a* into the airspace 116 of an attic, crawl space, garage, or similar space.

In the event of a fire, ambient air/smoke from airspace 116 would permeate through tube 102 to sensor 106*a*, which would activate alarm speaker 106*b* in a standard manner. To facilitate the alarm speaker 106*b* being heard inside the living space, cover 110 can include slots 110*a* that are covered on the inside with, for example, a polymeric film 108, such as DuPont Tyvec from DuPont Corp., Wilmington, Del., that would keep housing 104 substantially airtight but transfer sound readily. Additionally, slots 110*a* can be covered, for example, with a ceramic disc, or a metal disc of suitable thickness. Holes (not shown) or similar perforations can be used in lieu of or in addition to slots 110*a*.

FIG. 2, generally at 200, shows a second embodiment of an apparatus for enclosing smoke detector 106. A proximal end 202*b* of tube 202 may be secured to or integral with housing 204, which accommodates smoke detector 106. Housing 204 can have a frustoconical portion 204*a* and a cylindrical portion 204*b*. Mounting ring 206 can be secured to or integral with tube 202 or housing 204, and be used to secure apparatus 200, for example, to a ceiling 112, wall, floor, etc., such that a lower surface of a ceiling would contact an upper surface of mounting ring 206. Cover 110 engages housing 204 such that cover 110 secures smoke detector 106 within the confines of housing 204. In one embodiment of the present invention, cover 110 is a threaded cover. The distal end 202*a* of tube 202 can be inserted through a hole cut (or otherwise provided) into a ceiling 112, floor, wall, etc., and through any adjacent insulation 114 (as shown in FIG. 1) so that ambient air can flow through the tube to sensor 106*a*, which triggers alarm speaker 106*b*. Tube 202 can be sized such that it extends beyond, for example, any insulation thickness, indicated by arrow 114*a*, and into the airspace 116 of an attic, crawl space, garage, or similar space.

In the event of a fire, ambient air/smoke from airspace 116 would permeate through tube 202 to the enclosed smoke detector 106, thereby causing sensor 106*a* to activate alarm speaker 106*b* in a standard manner. To facilitate alarm speaker 106*b* being heard inside the living space, cover 110 can include slots 110*a* that are covered on the inside with, for example, a polymeric film 108, such as DuPont Tyvec from DuPont Corp., Wilmington, Del., that would keep housing 204 substantially airtight, while enabling it to readily allow sound waves to pass therethrough. Additionally, slots 110*a* can be covered, for example, with a ceramic disc, or a metal disc of suitable thickness. Holes (not shown) or similar perforation can be used in lieu of or in addition to slots 110*a*.

Figure 3:
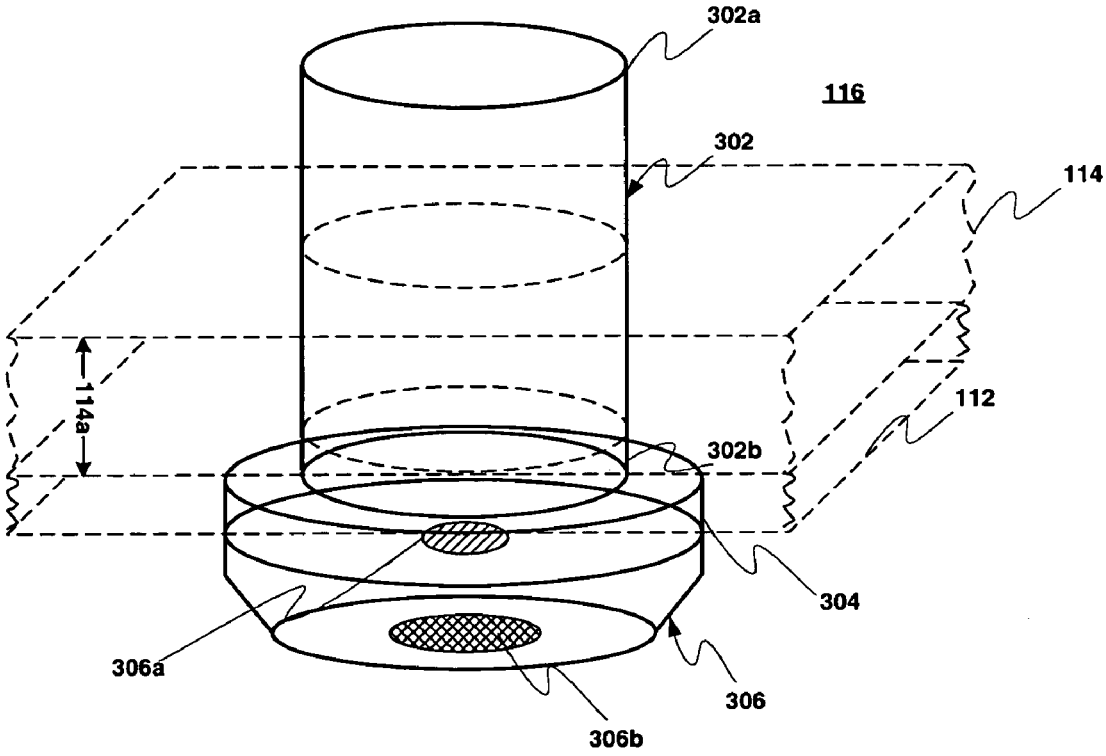
FIG. 3 is a schematic view of a third embodiment of an exemplary apparatus for housing a smoke detector.

FIG. 3, generally at 300, shows a third embodiment of an apparatus for enclosing a standard smoke and fire detector 306. A proximal end 302*b* of tube 302 may be secured to or integral with housing 304, such that tube 302 can be fitted through an opening in an insulated or non-insulated ceiling 112, wall, floor, etc., and into an adjacent attic, crawl space, garage, or similar air space 116 (as shown in FIG. 1). The internal diameter of housing 304 is large enough to be secured to or integral with smoke detector 306. Smoke detector 306 includes sensor 306*a* and alarm speaker 306*b* similar to those elements shown in FIG. 1. Smoke detector 306 is secured to or integral with housing 304 such that sensor 306*a* is secured within the confines of housing 304. The distal end 302*a* of tube 302 can be inserted through a hole cut (or otherwise provided) into a ceiling 112, floor, wall, etc., and through any adjacent insulation 114 (as shown in FIG. 1), so that ambient air can flow through tube 302 to sensor 306*a*, which will cause alarm speaker 306*b* to sound in a standard manner. Tube 302 can be sized such that it extends beyond, for example, any insulation 114 of width indicated by arrow 114*a* into the airspace of an attic, crawl space, garage, or similar space.

In the event of a fire, ambient air/smoke from the targeted space would permeate through tube 302 to sensor 306*a*, thereby sounding an alarm speaker 306*b* in a standard manner. To facilitate alarm speaker 306*b* being heard inside the living space, smoke detector 306 is engaged to housing 304 such that alarm speaker 306*b* faces the living space. In one embodiment, smoke detector 306 can be flush with housing 304. Alarm speaker 306*b* would keep smoke detector 306 substantially airtight but transfer sound readily to the living space.

Figure 4A:
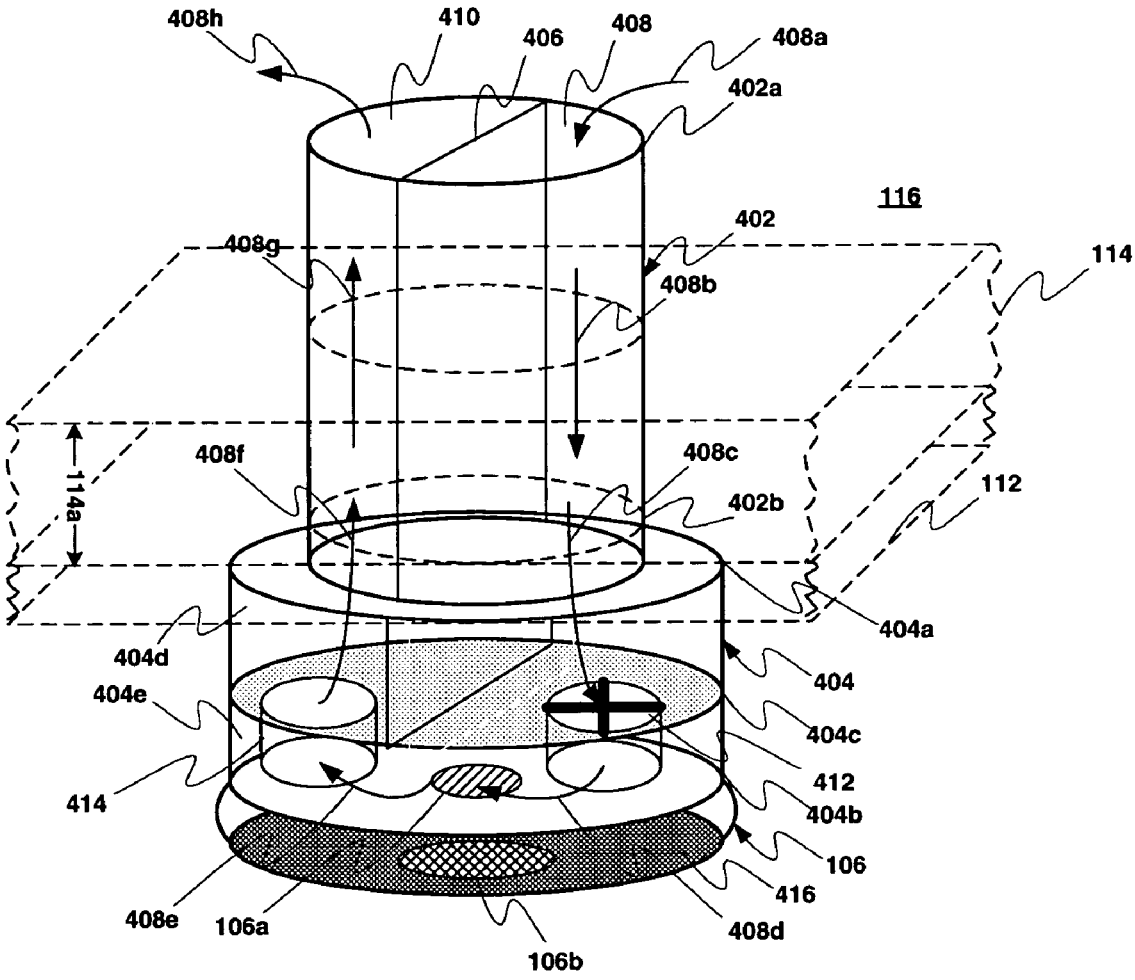
FIG. 4A is a schematic view of a fourth embodiment of an exemplary apparatus for housing a smoke detector that utilizes a single fan.
Figure 4B:
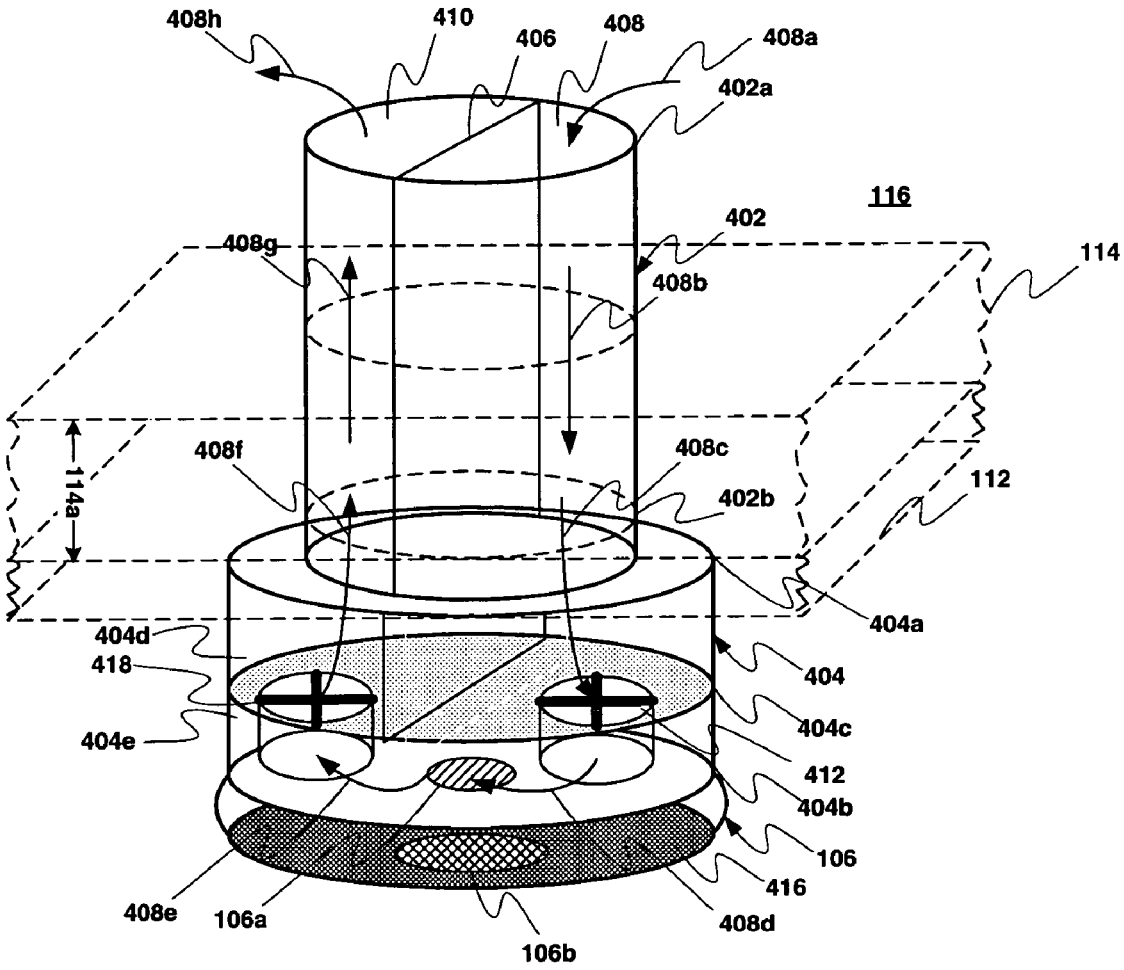
FIG. 4B is a schematic view of a fourth embodiment of an exemplary apparatus for housing a smoke detector that utilizes two fans.

FIG. 4A, generally at 400, shows a fourth embodiment of an apparatus for housing smoke detector that uses a single fan 412, whereas FIG. 4B shows a fourth embodiment of the present invention that uses two fans 412, 418.

With regard to FIGS. 4A and 4B, a proximal end 402*b* of tube 402 may be secured to or integral with housing 404, such that tube 402 can be fitted through an opening in an insulated or non-insulated ceiling 112, wall, floor, etc., and into an adjacent attic, crawl space, garage, or similar air space 116 (as shown in FIG. 1). The internal diameter of housing 404 is large enough to receive smoke detector 106.

Smoke detector 106 is secured to the proximal end 404*b* of housing 404. In one embodiment, smoke detector 106 can be flush with proximal end 404*b* of housing 404. Partition 406, which is generally planar, is positioned substantially vertically in tube 402. Partition 406 will substantially run the length of tube 402 and up to partition 404*c* in housing 404, and divide tube 402 into intake section 408 and exhaust section 410. Partition 404*c* divides housing 404 into sections 404*d* and 404*e*. Fan 412 is located within housing 404 between sections 404*d* and 404*e* within intake section 408, to enable air to be drawn from airspace 116 to smoke detector 106, and then return to airspace 116 through opening 414 and exhaust section 410. An opening could also be provided, for example, solely within the exhaust section 410 side of partition 404*c*, without the cylindrical opening 414 shown in FIG. 4A. In the embodiment of the present invention shown in FIG. 4B, fans 412 and 418 are located within housing 404 between section 404*d* and 404*e* respectively within intake section 408 and exhaust section 410, to enable air to be drawn from airspace 116 to smoke detector 106, and then return to airspace 116 through exhaust section 410.

Returning now to FIGS. 4A and 4B, the distal end 402*a* of tube 402 can be inserted through a hole cut (or otherwise provided) into a ceiling 112, wall, floor, etc., and through any adjacent insulation 114, so that ambient air can flow through intake section 408 of tube 402 to smoke detector 106. Tube 402 can be sized such that it extends beyond, for example, any insulation 114 of width indicated by arrow 114*a* into the airspace of an attic, crawl space, garage, or similar air space. The drawn air can subsequently be returned to airspace 116 through exhaust section 410, as generally indicated by arrows 408*a*, 408*b*, 408*c*, 408*d*, 408*e*, 408*f*, 408*g*, and 408*h*. Operation of fan 412 (FIG. 4A), and/or fan 418 (FIG. 4B) can be timed to occur for a short burst (e.g., 2-10 seconds), for example, every 15 to 30 minutes.

Proximal end 402*b* of tube 402 may be positioned within or integral with housing 404. Smoke detector 106 is located within housing 404. The distal end 402*a* of tube 402 can be inserted through a hole cut (or otherwise provided) into a ceiling, floor, wall, etc., and through any adjacent insulation (as shown in FIG. 1) so that ambient air can flow through intake section 408 to smoke detector 106. Tube 402 can be sized such that it extends beyond, for example, any insulation 114 of width indicated by arrow 114*a* into airspace 116.

In the event of a fire, ambient air/smoke drawn by fan 412 from airspace 116 would permeate through intake section 408 to sensor 106*a*, thereby sounding alarm speaker 106*b* in a standard manner. In one embodiment, to facilitate alarm speaker 106*b* being heard inside the living space, smoke detector 106 is engaged with the housing 404 such that the speaker (not shown) of alarm speaker 106*b* faces the living space. Alarm speaker 106*b* would keep smoke detector 106 substantially airtight but transfer sound readily to the living space. In one embodiment, to facilitate the alarm speaker 106*b* being heard inside the living space, smoke detector 106 can include slots 416 that are covered on the inside with, for example, a polymeric film, such as DuPont Tyvec from DuPont Corp., Wilmington, Del., that would keep housing 404 substantially airtight but transfer sound readily. Additionally, slots 416 can be covered, for example, with a ceramic disc, or a metal disc of suitable thickness. Holes (not shown) or similar perforation can be used in lieu of or in addition to slots 416.

The many features and advantages of the invention are apparent from the detailed specification, and thus, it is intended to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention. While the foregoing invention has been described in detail by way of illustration and example of preferred embodiments, numerous modifications, substitutions, and alterations are possible.

Having thus described my invention, what I claim as new and desire to secure by Letters Patent is as follows:

1. An apparatus for enclosing a smoke detector comprising:

a tubular extension having an open end for positioning within a space on a first side of a partition and a housing end for positioning within a space on a second side of the partition, wherein the open end is exposed to ambient air within the space on the first side of the partition;

at least one fan mounted inside the tubular extension, wherein the at least one fan facilitates the ambient air within the space on the first side of the partition to be drawn within the space on the second side of the partition;

a smoke detector enclosure for receiving the smoke detector, wherein at least a portion of the smoke detector enclosure contacts a portion of the tubular extension; and a cover that secures to the smoke detector enclosure, wherein the cover comprises at least one opening, and a film covers the at least one opening to provide substantially airtight smoke detector enclosure, and wherein the film facilitates transfer of audible alarm signal from the smoke detector to the space on the second side of the partition.

2. The apparatus of claim 1, wherein the tubular extension and the smoke detector enclosure comprise an integral structure.

3. The apparatus of claim 1, wherein at least a portion of the smoke detector enclosure comprises a larger diameter than a largest diameter of the tubular extension.

4. The apparatus of claim 1, wherein at least a portion of the smoke detector enclosure comprises a smaller diameter than a largest diameter of the tubular extension.

5. The apparatus of claim 1, wherein a surface of the smoke detector enclosure contacting the housing end of the tubular extension comprises a substantially same diameter as a diameter of the tubular extension contacting the surface of the smoke detector enclosure.

6. The apparatus of claim 1, wherein the at least one fan is mounted proximate the open end, wherein the at least one fan facilitates the ambient air within the space on the first side of the partition to be drawn via the open end into the housing end.

7. The apparatus of claim 1, wherein the at least one fan is mounted proximate the housing end, wherein the at least one fan facilitates the ambient air within the space on the first side of the partition to be drawn via the open end into the housing end.

8. An apparatus for enclosing a smoke detector, comprising:

a tubular extension having an open end for positioning within a space on a first side of a partition and a housing end for positioning within a space on a second side of the partition, wherein the open end receives ambient air that passes through the tubular extension toward the housing end;

a substantially planar partition positioned within the tubular extension, partitioning the tubular extension into an intake portion and an exhaust portion;

a smoke detector enclosure for receiving the smoke detector, wherein at least a portion of the smoke detector enclosure contacts a portion of the tubular extension; and a fan that directs air to the smoke detector.

9. The apparatus of claim 8, further comprising a cover that secures to the smoke detector enclosure.

10. The apparatus of claim 9, wherein the cover comprises a threaded cover.

11. The apparatus of claim 9, wherein the cover comprises at least one opening, and a film covers the at least one opening.

12. The apparatus of claim 8, wherein the fan is positioned within the intake portion.

13. The apparatus of claim 12, wherein when the fan is operating, air moves within the intake portion from the open end to the housing end.

14. The apparatus of claim 13, further comprising a second fan that is positioned on the exhaust partition side and facilitates moving air from the intake portion to the exhaust portion.

15. The apparatus of claim 8, wherein a surface of the smoke detector enclosure contacting the housing end of the tubular extension comprises a larger diameter than a largest diameter of the tubular extension.

* * * * *

UNITED STATES PATENT AND TRADEMARK OFFICE

CERTIFICATE OF CORRECTION

PATENT NO. : 7,504,962 B2
APPLICATION NO. : 11/283712
DATED : March 17, 2009
INVENTOR(S) : Joseph S. Smith It is certified that error appears in the above-identified patent and that said Letters Patent is hereby corrected as shown below:

On the cover page, item (76), after "Inventor: Joseph Stephen Smith," please replace "3458 Woodbridge Pkwy., Palm Harbor, FL (US) 34684" with "9252 Bonnington Dr., Trinity, FL (US) 34655"

Signed and Sealed this

Fourth Day of May, 2010

David J. Kappos

David J. Kappos
*Director of the United States Patent and Trademark Office*